US010638860B1

(12) United States Patent
Duncan

(10) Patent No.: US 10,638,860 B1
(45) Date of Patent: May 5, 2020

(54) CONTOURED PILLOW

(71) Applicant: Christine M. Duncan, Sioux Falls, SD (US)

(72) Inventor: Christine M. Duncan, Sioux Falls, SD (US)

( * ) Notice: Subject to any disclaimer, the term of this patent is extended or adjusted under 35 U.S.C. 154(b) by 251 days.

(21) Appl. No.: 15/887,694

(22) Filed: Feb. 2, 2018

(51) Int. Cl.
*A47G 9/10* (2006.01)

(52) U.S. Cl.
CPC .... *A47G 9/1081* (2013.01); *A47G 2009/1018* (2013.01)

(58) Field of Classification Search
CPC ..... A47G 9/1081; A47G 9/10
USPC ..... D6/601
See application file for complete search history.

(56) References Cited

U.S. PATENT DOCUMENTS

| | | | | |
|---|---|---|---|---|
| D126,825 | S | 4/1941 | Kolisch | |
| 2,522,120 | A * | 9/1950 | Kaskey | A47G 9/10 5/636 |
| 2,880,428 | A * | 4/1959 | Forsland | A47G 9/10 5/636 |
| 3,667,074 | A * | 6/1972 | Emery | A47G 9/109 5/636 |
| 4,007,503 | A | 2/1977 | Watkin | |
| 4,748,702 | A | 6/1988 | Sandler | |
| 5,138,732 | A | 8/1992 | Wattie | |
| D391,112 | S | 2/1998 | Houston | |
| 6,098,220 | A * | 8/2000 | Momma | A47G 9/1009 5/636 |
| D471,750 | S | 3/2003 | Jamvold | |
| 7,975,336 | B1 | 7/2011 | Perry | |
| D701,710 | S | 4/2014 | Martinez | |
| 8,707,485 | B1 | 4/2014 | Conley | |
| 8,893,334 | B1 | 11/2014 | Wong | |
| 8,973,190 | B2 | 3/2015 | Oh | |
| 9,089,230 | B2 | 7/2015 | Cho | |
| 9,326,906 | B2 | 5/2016 | Thanas | |
| 9,375,104 | B2 | 6/2016 | Abdo | |
| 9,795,232 | B2 | 10/2017 | Holbrook | |
| 2009/0307846 | A1 * | 12/2009 | Eura | A47C 7/383 5/636 |
| 2012/0060846 | A1 | 3/2012 | Leoniak | |

* cited by examiner

*Primary Examiner* — Eric J Kurilla
*Assistant Examiner* — James T Coble
(74) *Attorney, Agent, or Firm* — Jeffrey A. Proehl; Woods, Fuller, Shultz & Smith, PC

(57) ABSTRACT

A contoured pillow having a top and a bottom for resting upon a surface, and including an outer cover and padding positioned in the outer cover. The pillow may have a central portion extending along a central lateral axis and lobe portions extending outwardly from the central portion, and an upper surface of the central portion may include proximal and distal sections. The proximal section of the upper surface may be located a greater distance from the bottom of the pillow than the distal section of the upper surface.

15 Claims, 3 Drawing Sheets

CONTOURED PILLOW

BACKGROUND

Field

The present disclosure relates to pillows and more particularly pertains to a new contoured pillow for supporting portions of the head and neck of the user in a proper orientation with respect to each other while also resisting the tendency of the head to rotate to one lateral side or the other when the user falls asleep.

SUMMARY

The present disclosure relates to a contoured pillow having a top and a bottom for resting upon a surface, and a reference plane for positioning substantially parallel to the surface upon which the pillow rests during use. The pillow may be elongated along a central longitudinal axis between opposite ends, with opposite sides extending between the ends that include a proximal side for positioning relatively closer to the shoulder of the user during use and a distal side for positioning relatively closer to the head of the user during use. The pillow may have a central lateral axis extending substantially perpendicular to the central longitudinal axis. The pillow may have an outer surface with an outer perimeter, an upper surface located above the perimeter, and a lower surface located below the perimeter. The pillow may comprise an outer cover forming the outer surface and defining an interior, and padding positioned in at least a portion of the interior of the outer cover. The pillow may have a central portion extending along the central lateral axis, and lobe portions extending outwardly from the central portion. The upper surface of the central portion includes a proximal section and a distal section, with the proximal section of the upper surface being configured to support a portion of the neck of the user during use and the distal section of the upper surface being configured to support a portion of the head of the user during use. The proximal section of the upper surface may be located a greater distance from the bottom of the pillow than the distal section of the upper surface.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
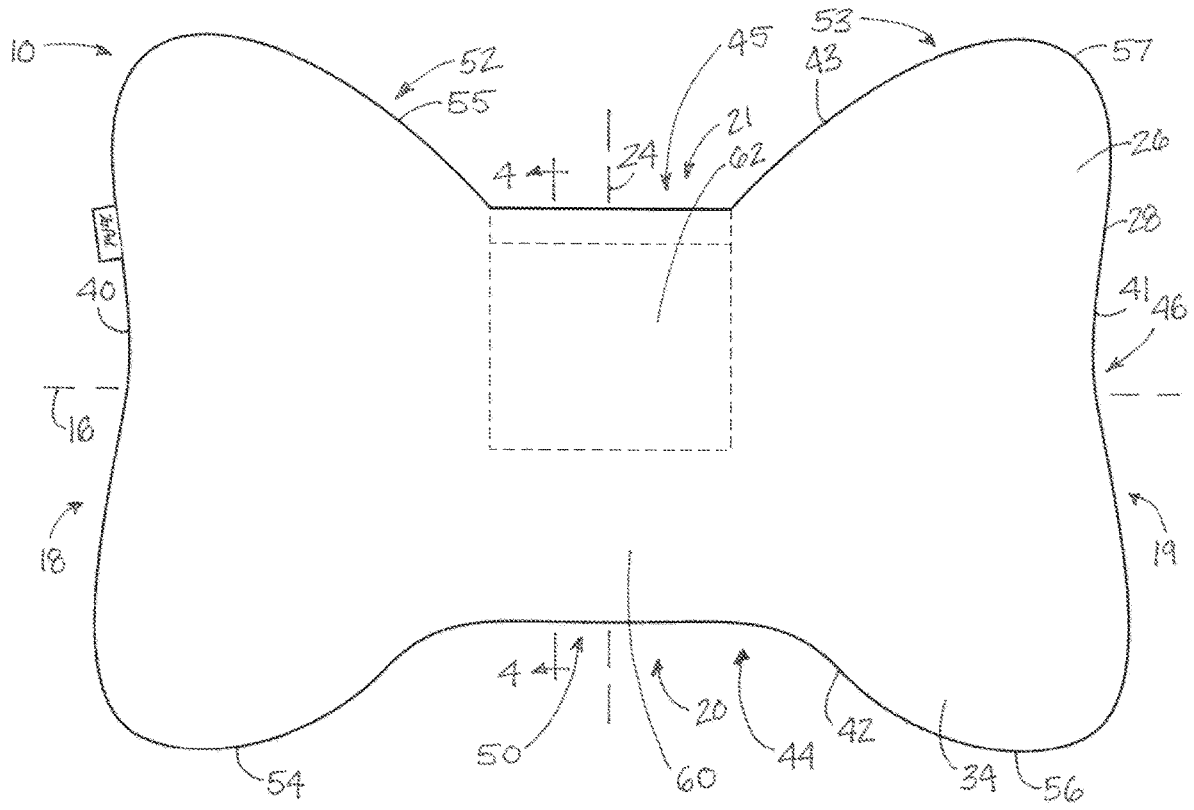
FIG. 1 is a schematic top view of a new contoured pillow according to the present disclosure.
Figure 2:
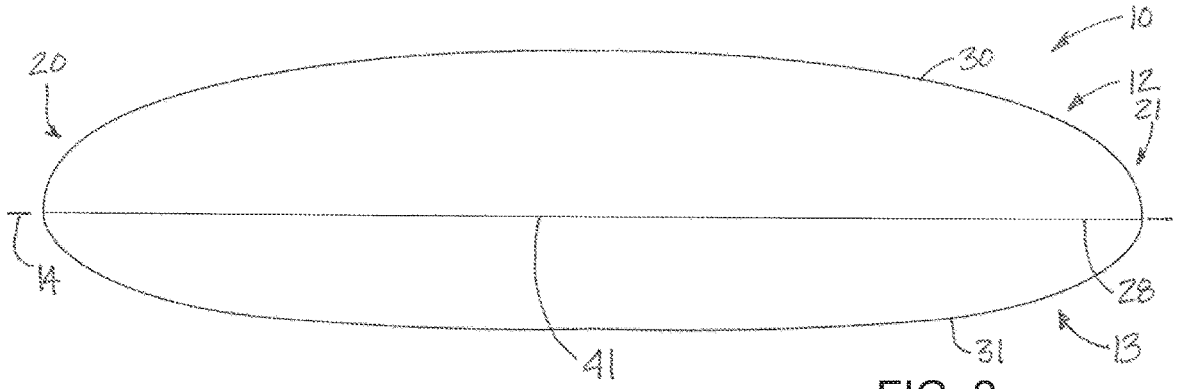
FIG. 2 is a schematic first end view of the pillow, according to an illustrative embodiment.
Figure 3:
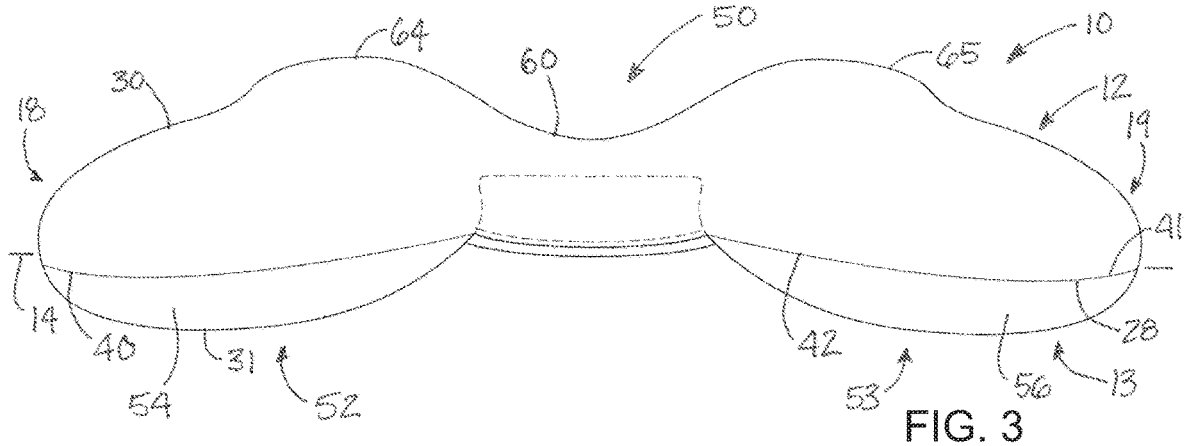
FIG. 3 is a schematic proximal side view of the pillow, according to an illustrative embodiment.
Figure 4:
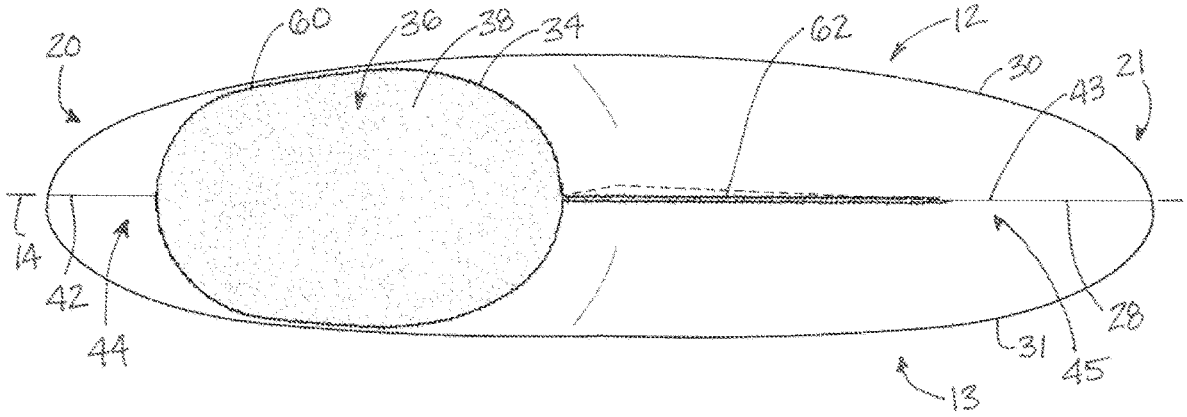
FIG. 4 is a schematic sectional view of the pillow taken along line 4-4 of FIG. 1, according to an illustrative embodiment.

With reference now to the drawings, and in particular to FIGS. 1 through 4 thereof, a new contoured pillow embodying the principles and concepts of the disclosed subject matter will be described.

The applicant has recognized problems that occur when a person in a reclined or prone position relaxes and falls asleep, and the person's head naturally tends to flop or rotate toward one side of the body or the other. Quite often this unintentional rotation of the head results in pain or stiffness of the neck and/or upper back of the person if the head remains in this position for too long a period, which can be fairly likely if the person has fallen asleep. The applicant has also recognized that conventional throw pillows are unable to resist this rotation, and in some cases may even encourage this undesirable movement. Other circular pillows with a central void may tend to support the head at a level that is too high with respect to the neck of the person, which can also lead to pain or discomfort if the position is maintained for a longer period.

The applicant has thus devised a pillow with contouring that supports portions of the head and neck of the user in a proper orientation with respect to each other, and also resists the tendency of the head to rotate to one lateral side or the other when the person falls asleep. Advantageously, when the head and neck are supported in a proper orientation that does not favor one side or the other, the user is much more likely to awake without pain or discomfort.

In one aspect, the disclosure relates to a contoured pillow 10 which generally has a top 12 and a bottom 13 for resting upon a surface such as a bed. For point of reference in this description, the pillow 10 may be thought to have a reference plane 14 which may be oriented substantially parallel to the surface upon which the pillow rests during use. The pillow may be elongated along a central longitudinal axis 16 between opposite ends 18, 19 of the pillow. The pillow may also have opposite sides 20, 21 which extend between the ends 18, 19 and may include a proximal side 20 for positioning relatively closer to the shoulder of the user during use, and a distal side 21 for positioning relatively closer to the head of the user during use. The pillow 10 may also have a central lateral axis 24 which extends substantially perpendicular to the central longitudinal axis 16.

The pillow 10 may have an outer surface 26, and the outer surface may have an outer perimeter 28 positioned between an upper portion of the outer surface 26, or upper surface 30, located above the outer perimeter 28 in between the perimeter and the top 12. The outer surface may also include a lower portion of the outer surface, or lower surface 31, which is located below the outer perimeter 28, and may be located between the perimeter 28 and the bottom 13. A thickness of the pillow 10 may be defined between the upper 30 and lower 31 surfaces of the pillow, and the thickness may vary across different locations on the pillow.

The pillow 10 may include an outer cover 34 which forms the outer surface 26 of the pillow, and may define an interior 36 of the pillow. The outer cover 34 may be formed from a relatively thin and flexible material which may also exhibit some degree of resilient stretchability. The pillow 10 may also include padding 38 which may be positioned in at least a portion of the interior 36 of the outer cover. The padding 38 may be formed of a resiliently compressible material, such as a foamed material or other material having resiliently compressible characteristics.

The outer perimeter 28 of the pillow has a shape and the perimeter may include end sections 40, 41 which are located at the opposite ends 18, 19 of the pillow and side sections 42, 43 which are located at the opposite sides 20, 21 of the pillow. In some embodiments, each of the side sections 42, 43 may be generally concave to form side divots 44, 45. The side divots may include a proximal side divot 44 and a distal side divot 45. The proximal side divot 44 may be configured for receiving a portion of the neck of the user, while the distal side divot 45 may be configured for receiving a portion of the head of the user. Additionally, each of the end sections 40, 41 may also be generally concave to form end divots 46. As a result, some embodiments of the pillow 10 may have a shape that approximates a stereotypical "dog bone" shape.

The pillow 10 may also have a central portion 50 which extends along the central lateral axis 24, and lobe portions 52, 53 which extend in a longitudinally outwardly direction from the central portion 50, and the lobe portions generally extend laterally with respect to the central longitudinal axis 16. At least one of the lobe portions may extend in a substantially opposite lateral direction with respect to another lobe portion. In greater detail, a first pair 54, 55 of the lobe portions may be located on a first end 18 of the pillow and a second pair 56, 57 of lobe portions may be located on a second end 19 of the pillow. As a result, two of the lobes 54, 56 may extend in a first lateral direction with respect to the central longitudinal axis 16 and two of the lobes 55, 57 may extend in a second lateral direction with respect to the central longitudinal axis.

The upper surface 30 of the central portion 50 of the pillow 10 may include a proximal section 60 and a distal section 62. The proximal section 60 may be configured to support a portion of the neck of the user during use of the pillow, and the distal section of the upper surface may be configured to support a portion of the head of the user during use. The proximal section 60 may be located adjacent to the proximal side divot 44, while the distal section 62 may be located adjacent to the distal side divot 45.

Significantly, the proximal section 60 of the upper surface may be convex for supporting a portion of the neck of the user, and the distal section 62 of the upper surface may be substantially planar. In some embodiments, the proximal section of the upper surface is located a greater distance from the bottom 13 of the pillow than the distal section of the upper surface. In some further embodiments, all portions of the proximal section may be located a greater distance from the bottom of the pillow than all portions of the distal section of the upper surface. The proximal section of the upper surface may be located above the reference plane 14 and the distal section of the upper surface may be located substantially in the reference plane 14.

A portion of the interior 36 of the pillow that corresponds to the proximal section 60 of the upper surface may contain padding, and a portion of the interior corresponding to the distal section 62 of the upper surface may contain no padding between the portions of the outer cover 34 which form the central portion 50 at the distal section. The thickness of the distal section 62 of the central portion along the central lateral axis 24 may be less than the thickness of the proximal section 60 of the central portion along the central lateral axis. The thickness of the pillow 10 at the central portion 50 may generally be less than the thickness of the pillow at the lobe portions. The distal section of the upper surface is thus better able to conform to the contours of the rear surface of the user's head, while the proximal section of the upper surface is relatively less likely to collapse under the weight of the user's neck to provide relatively greater vertical support to the neck than the head of the user.

In some embodiments, the upper surface may have a protrusion 64, 65 located on each of the lobe portions 52, 53 of the pillow, and the protrusion 64, 65 may be located adjacent to the central portion 50 to provide greater resistance to the head and neck of the user from moving from the central portion toward or on to one of the lobe portions of the pillow.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A contoured pillow having a top and a bottom for resting upon a surface, the pillow having a reference plane for positioning substantially parallel to the surface upon which the pillow rests during use, the pillow being elongated along a central longitudinal axis between opposite ends, the pillow having opposite sides extending between the ends including a proximal side for positioning relatively closer to the shoulder of the user during use and a distal side for positioning relatively closer to the head of the user during use, the pillow having a central lateral axis extending substantially perpendicular to the central longitudinal axis, the pillow having an outer surface, the outer surface having an outer perimeter, the outer surface including an upper surface located above the perimeter and a lower surface located below the perimeter, the pillow comprising:

an outer cover forming the outer surface and defining an interior, the outer cover having an upper section forming the upper surface of the pillow and a lower section forming the lower surface of the pillow; and padding positioned in at least a portion of the interior of the outer cover;

wherein the pillow has a central portion extending along the central lateral axis and lobe portions extending outwardly from the central portion;

wherein the upper surface of the central portion includes a proximal section extending from the proximal side of the pillow toward the distal side of the pillow, and the upper surface of the central portion including a distal section extending from the distal side of the pillow toward the proximal side of the pillow;

wherein padding is positioned between the upper and lower sections of the outer cover at the proximal section of the upper surface to resist collapse of the proximal section in support of a portion of the neck of the user during use; and wherein no padding is positioned between the upper and lower sections of the outer cover at the distal section of the upper surface to facilitate deflection of the distal section in support of a portion of the head of the user during use.

2. The pillow of claim 1 wherein all portions of the proximal section being located a greater distance from the bottom of the pillow than all portions of the distal section of the upper surface.

3. The pillow of claim 1 wherein the proximal section of the upper surface is convex for supporting the portion of the neck of the user and the distal section of the upper surface is substantially planar.

4. The pillow of claim 1 wherein the proximal section of the upper surface is located above the reference plane and the distal section of the upper surface being located substantially in the reference plane.

5. The pillow of claim 1 wherein the outer cover is formed of a resiliently stretchable material facilitating deflection of the distal section of the upper surface of the pillow.

6. The pillow of claim 1 wherein a thickness of the distal section along the central lateral axis being less than a thickness of the proximal section along the central lateral axis.

7. The pillow of claim 1 wherein a thickness of the pillow is defined the upper and lower surfaces, the thickness of the pillow at the central portion being less than the thickness at the lobe portions.

8. The pillow of claim 1 wherein the padding is formed by a resiliently compressible material.

9. The pillow of claim 1 wherein the upper surface has a protrusion located on each of the lobe portions adjacent to the central portion.

10. The pillow of claim 1 wherein the outer perimeter has end sections located at the opposite ends of the pillow and side sections located at the opposite sides of the pillow, each of the side sections being concave to form side divots, the side divots comprising a proximal side divot and a distal side divot.

11. The pillow of claim 10 wherein the proximal section is located adjacent to the proximal side divot and the distal section is located adjacent to the distal side divot.

12. The pillow of claim 1 wherein the lobe portions extend laterally with respect to the central longitudinal axis.

13. The pillow of claim 1 wherein at least one lobe portion extends in a substantially opposite lateral direction with respect to another lobe portion.

14. The pillow of claim 13 wherein a first pair of the lobe portions are located on a first end of the pillow and a second pair of lobe portions are located on a second end of the pillow.

15. The pillow of claim 14 wherein two of the lobes extend in a first lateral direction with respect to the central longitudinal axis and two of the lobes extend in a second lateral direction with respect to the central longitudinal axis.

* * * * *